US007690132B2

(12) United States Patent
Wilkenfeld

(10) Patent No.: US 7,690,132 B2
(45) Date of Patent: Apr. 6, 2010

(54) DANCE SHOE

(75) Inventor: David Wilkenfeld, Sydney (AU)

(73) Assignee: Pointe Noir Pty Ltd., Pyrmont (AU)

( * ) Notice: Subject to any disclaimer, the term of this patent is extended or adjusted under 35 U.S.C. 154(b) by 802 days.

(21) Appl. No.: 11/550,266

(22) Filed: Oct. 17, 2006

(65) Prior Publication Data

US 2008/0086906 A1 Apr. 17, 2008

(51) Int. Cl.
*A43B 5/12* (2006.01)
*A43B 1/10* (2006.01)

(52) U.S. Cl. ..... 36/8.1; 36/102; 36/24.5

(58) Field of Classification Search ..... 36/24.5, 36/8.1, 102, 103, 31
See application file for complete search history.

(56) References Cited

U.S. PATENT DOCUMENTS

| | | | | |
|---|---|---|---|---|
| 726,778 | A | 4/1903 | Smith | |
| 900,881 | A | 10/1908 | Parker | |
| 1,754,054 | A | 4/1930 | Selva | |
| 1,953,659 | A | 4/1934 | Savino | |
| 2,252,315 | A | 8/1941 | Doree | |
| 2,332,252 | A * | 10/1943 | Payne | 36/106 |
| 2,544,270 | A | 3/1951 | L'Hollier | |
| 3,609,888 | A | 10/1971 | Rickman | |
| 4,199,878 | A | 4/1980 | Wossner | |
| D266,455 | S | 10/1982 | Famolare, Jr. | |
| D276,190 | S | 11/1984 | Hess | |
| 4,583,304 | A | 4/1986 | Spalding | |
| 4,944,099 | A | 7/1990 | Davis | |
| 5,035,069 | A | 7/1991 | Minden | |
| D339,669 | S | 9/1993 | Miller | |
| 5,257,969 | A | 11/1993 | Mance | |
| 5,513,449 | A | 5/1996 | Gramola | |
| 5,682,685 | A | 11/1997 | Terlizzi | |

(Continued)

FOREIGN PATENT DOCUMENTS

| | | |
|---|---|---|
| CA | 1077711 | 5/1980 |

(Continued)

OTHER PUBLICATIONS

Advertisement by LaDuca in Sep. 2001 issue of "Dance Spirit" magazine published by Lifestlye Media as cited during prosecution of U.S. Patent No. 7,051,458, granted May 30, 2006 to LaDuca.

(Continued)

*Primary Examiner*—Marie Patterson
(74) *Attorney, Agent, or Firm*—Ganz Law, P.C.

(57) ABSTRACT

A shoe for dancing, comprising a forefoot portion, wherein the forefoot portion comprises a forefoot sole and a front upper; a rearfoot portion comprising a rearfoot sole including a high heel; a midfoot portion comprising a midfoot sole; and a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement.

25 Claims, 8 Drawing Sheets

U.S. PATENT DOCUMENTS

| | | | | |
|---|---|---|---|---|
| 5,806,209 | A | 9/1998 | Crowley et al. | |
| 5,956,868 | A * | 9/1999 | Stevens et al. | 36/8.3 |
| 5,996,251 | A | 12/1999 | LaDuca | |
| 6,076,284 | A | 6/2000 | Terlizzi | |
| 6,588,124 | B2 | 7/2003 | Morrone | |
| 6,634,121 | B2 | 10/2003 | Sordi | |
| 6,745,498 | B2 * | 6/2004 | LaDuca | 36/8.3 |
| D515,299 | S | 2/2006 | Burg | |
| D517,784 | S | 3/2006 | Wilkenfeld et al. | |
| 7,047,669 | B2 * | 5/2006 | Polcek | 36/25 R |
| 7,051,458 | B2 * | 5/2006 | LaDuca | 36/8.3 |
| D522,722 | S | 6/2006 | Wilkenfeld et al. | |
| D524,015 | S | 7/2006 | Burg | |
| D538,515 | S | 3/2007 | Wilkenfeld et al. | |
| D556,436 | S | 12/2007 | Wilkenfeld et al. | |
| 2001/0005947 | A1 | 7/2001 | Sordi | |
| 2002/0078591 | A1 | 6/2002 | Morrone | |
| 2003/0029055 | A1 | 2/2003 | Morrone | |
| 2003/0033729 | A1 | 2/2003 | Farrior | |
| 2003/0121176 | A1 | 7/2003 | Baruck | |
| 2005/0132611 | A1 * | 6/2005 | Polcek | 36/35 R |
| 2006/0174512 | A1 * | 8/2006 | LaDuca | 36/8.3 |
| 2007/0256330 | A1 * | 11/2007 | Wallin et al. | 36/102 |
| 2008/0034613 | A1 | 2/2008 | Wilkenfeld et al. | |

FOREIGN PATENT DOCUMENTS

| | | | |
|---|---|---|---|
| CH | 168702 | | 4/1933 |
| EP | 562697 | A1 | 9/1993 |
| EP | 0672362 | A1 | 9/1995 |
| WO | WO9938404 | A1 | 8/1999 |
| WO | WO02051274 | A1 | 7/2002 |
| WO | WO2006037154 | A1 | 4/2006 |

OTHER PUBLICATIONS

Experimental Sales by LaDuca prior to Sep. 2001 as cited during prosecution of U.S. Patent No. 7,051,458, granted May 30, 2006 to LaDuca.

PCT International Search Report and Written Opinion dated Nov. 7, 2005 prepared by ISA/AU for PCT Appl. No. PCT/AU2005/001504; filed Sep. 29, 2005; 11 pages.

Examination report dated Sep. 12, 2008 for corresponding Australian patent application No. AU2005291828, filed Sep. 29, 2005; 3 pages.

* cited by examiner

DANCE SHOE

BACKGROUND

American musical theater has changed quite significantly over the past few decades. The popular shows of Broadway in the years following World War TI involved similar music and dance numbers of a particular style and choreography. Some people consider the 1950s as the Golden Age of Broadway when shows like Oklahoma, The Sound of Music, Kismet, and The King and I dominated the stage. These sophisticated, high-budget productions featured talented actors, singers, and dancers, but the dance choreography centered around one particular style for each entire show—ballroom, jazz, or some type of character dancing, such as country, folk, or Celtic dancing. Dancers usually engaged in a single, traditional dance style throughout an entire performance.

Bob Fosse, Broadway's great jazz dance innovator, appeared on the scene in the late 50s and ushered in a transition to high-energy, intense, and demanding dance choreography. Dancers required great stamina and the ability to combine precise hand gestures, rapid kicks, forceful foot action, and sinuous body movements. Fosse's style is best exemplified in the Broadway musical Chicago (1975) and the film, Cabaret (1972). Rock musicals such as Jesus Christ Superstar, Hair, Grease, and The Wiz appeared around the same time, bringing new energy and innovative dance routines to American musicals. Fosse's twist on traditional jazz dancing and the influence of rock music brought high-energy routines to Broadway musicals, but shows still regularly followed a consistent dance style. Performers in these shows needed to perform only a single dance style (though often with some variation) and required only basic dance shoes of an appropriate type.

Since the late 1980s, however, Broadway musicals have become far more elaborate and complicated. Technological innovations in set design, lighting, and costuming have allowed stunningly expansive productions like The Lion King, Miss Saigon, Les Miserables, and Wicked. Innovation swept through dance moves and choreography as well, leading to multiple different dance styles being incorporated into the same show, or even a single number within a show. Productions like Stomp, Rent, and Fosse fused and mixed jazz, character, tap, ballroom, ballet, African, and modern dance. Obviously, dancers in these shows would benefit from a dance shoe that offered the mechanical and aesthetic flexibility necessary to perform such a complicated set of routines.

Today's musicals demand dancers who can shift among many different dance styles, often within a matter of minutes or seconds, and dancers demand shoes that facilitate and enhance their abilities to do so. Dancers must leap and jump across the stage, glide effortlessly with partners, and sweep their legs broadly in curving arcs. They must straighten their legs and point their feet in ballet-like movements one moment, and switch to kicks, stomps, and turns on the next beat of music. All of these intricate choreographies incorporate isolated smooth, controlled, pliable manipulations of the foot and toes rooted in jazz and ballet with highly energetic movements from character dancing, such as stomping, kicking, gliding, jumping, turning, or scuffing. Elements of tap dancing (with or without actual tap plates on the shoes) are often incorporated as well.

Each dance style requires a shoe capable of facilitating and enhancing the movements of that style. For example, character dancing requires high-heel shoes with strength, rigidity, and support sufficient for performing energetic dance movements (kicking, jumping, stomping, etc.). Character shoes limit flexibility in favor of reinforcing the dancer's feet. To this end, character dance shoes commonly have hard leather soles and firm, strong shoe uppers. They have traditional high heels, which are rigid and typically more than 1½" high and relatively low forefoot sections. The heels usually taper from a broader area at the top-end, corresponding to the heel, to a reduced area at the bottom-side for ground contact. Accordingly, because of the heel-to-toe slope, the wearer's arch is considerably raised it and must be supported when weight bearing. In this regard, character shoes typically have rigid shanks spanning across their midfoot portion under the arch. Problematically, this form of constructions does not adequately afford the flexibility needed for jazz dance moves, particularly plantar flexion for pointing—a rigid midfoot portion impedes contraction of the arch, which is key to the pointing aesthetic.

In contrast, traditional jazz dancing shoes sacrifice reinforcing support in favor of flexibility and pliability. Traditional jazz dance shoes often are similar to ballet shoes or slippers, with soft soles and pliable shoe uppers that do not overly restrict the foot, allow a broader range of foot movement. They typically have a flat heel, which, relative to the forefoot of the shoe, result in a shoe that has little or no slope or elevated arch. The heels also provide a relative broad area of ground contact.

Accordingly, problems arise when dancers are forced to choose one style of shoe—either a character or a jazz shoe—for musicals or dance numbers incorporating such a blend of dance styles or movements. Dancers cannot change shoes in the middle of a number to accommodate a change in style, and they often have very little time for costume changes between dance numbers in a single performance.

In an attempt to address the foregoing problems, U.S. Pat. No. 5,996,251 describes a combination jazz dancing and character/tap dancing shoe and U.S. Pat. No. 6,745,498. However, the metal or hard leather shanks in these shoes do not offer the wearer optimum flexibility in the area of the shoe underneath the arch of the foot. In fact, the only area of moderate or substantial flexibility in the sole of a shoe described in the '498 patent is a small area in the rear of the front portion of the shoe between the rigid shank 30 and the support 70.

In view of the forgoing, there is an ever-present need for improved dance footwear that better balances the needs for support and flexibility in the region under the arch of the foot and elsewhere. Additionally, there is an ever-present need for better constructed dance footwear, including stronger construction of high heel portions, which historically have been prone to breakage.

SUMMARY

The inventive subject matter overcomes problems inherent in traditional dance shoes (described above) by providing dance footwear that offers the strength and support necessary for many types of dance, yet still allows the wearer to accomplish fluid moves of the foot, such as flexing and pointing. In particular, the inventive subject matter contemplates a shoe for dancing, comprising: a forefoot portion, wherein the forefoot portion comprises a forefoot sole and a front upper; a rearfoot portion comprising a rearfoot sole including a high heel; a midfoot portion comprising a midfoot sole; and a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement.

In certain respects the inventive subject matter contemplates a combination of a shorter or "truncated" shank and an elastic section that wraps around the underside of the shoe, attaching to either side of the forefoot upper, combining to enhance a dancer's pointe. The combination helps a dancer to better articulate, as it works with the foot to provide an extended range of movement. In combination with an asymmetric upper that encases the metatarsal heads of a foot, the shoe also provides an aesthetic, extended line when a dancer is pointing.

In some embodiments, the shoes according to the inventive subject matter have a rigidified section wherein the ratio of the insole length to the rigidified section length is from about 2.5 to about 3.0.

Dance shoes according to the inventive subject matter are particularly suitable for jazz, character and interdisciplinary demi-character work.

These and other embodiments are described in more detail in the following detailed descriptions and the figures. The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The figures show a representative embodiment of a shoe according to the inventive subject matter. This particular embodiment is a shoe fitted for the right foot of a wearer, except FIG. 10A which is a left shoe.

FIG. 3 is a rear view of the embodiment illustrated in FIG. 1.

DETAILED DESCRIPTION

Figure 1:
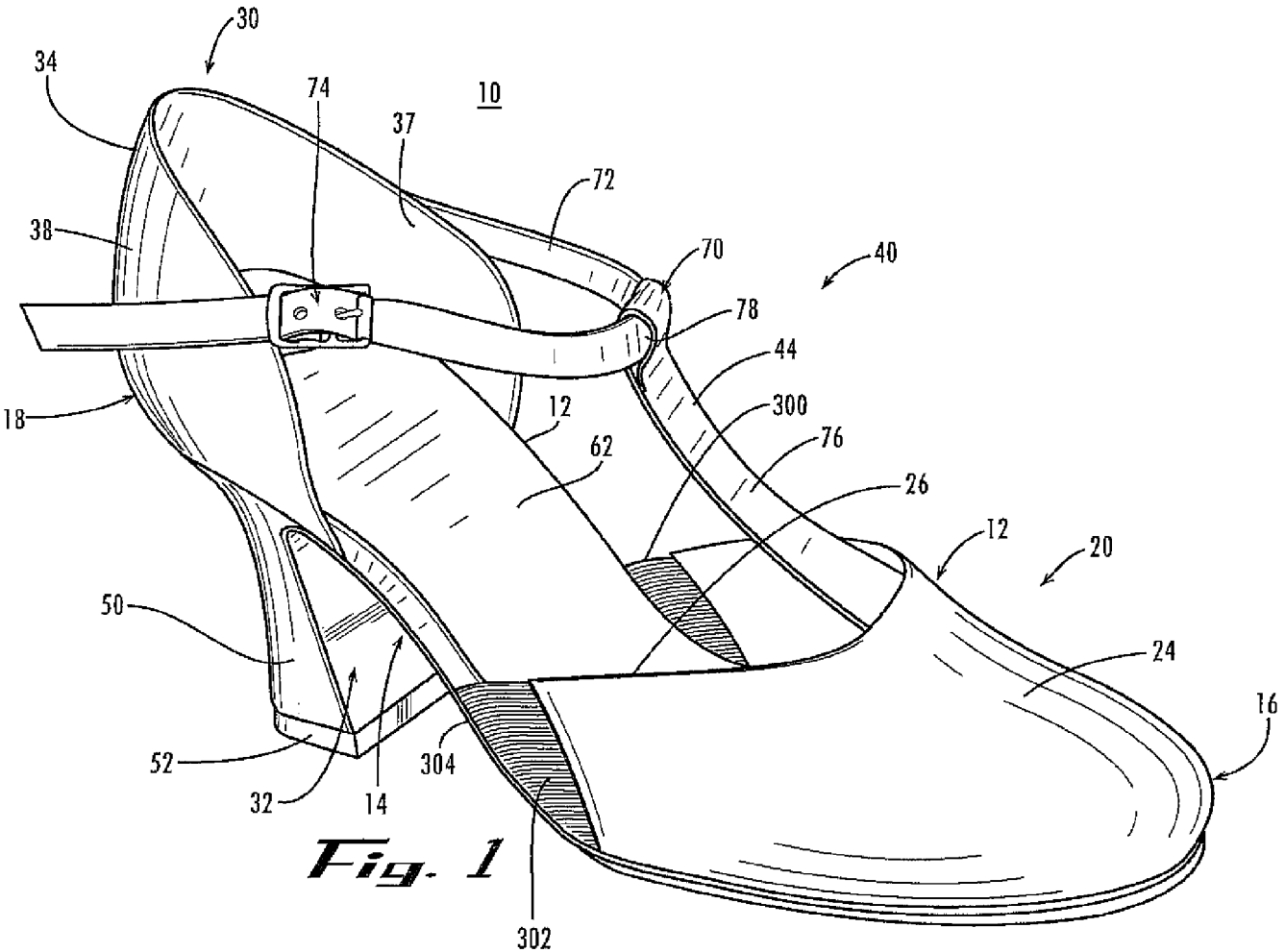
FIG. 1 is a perspective view of one embodiment
Figure 1:
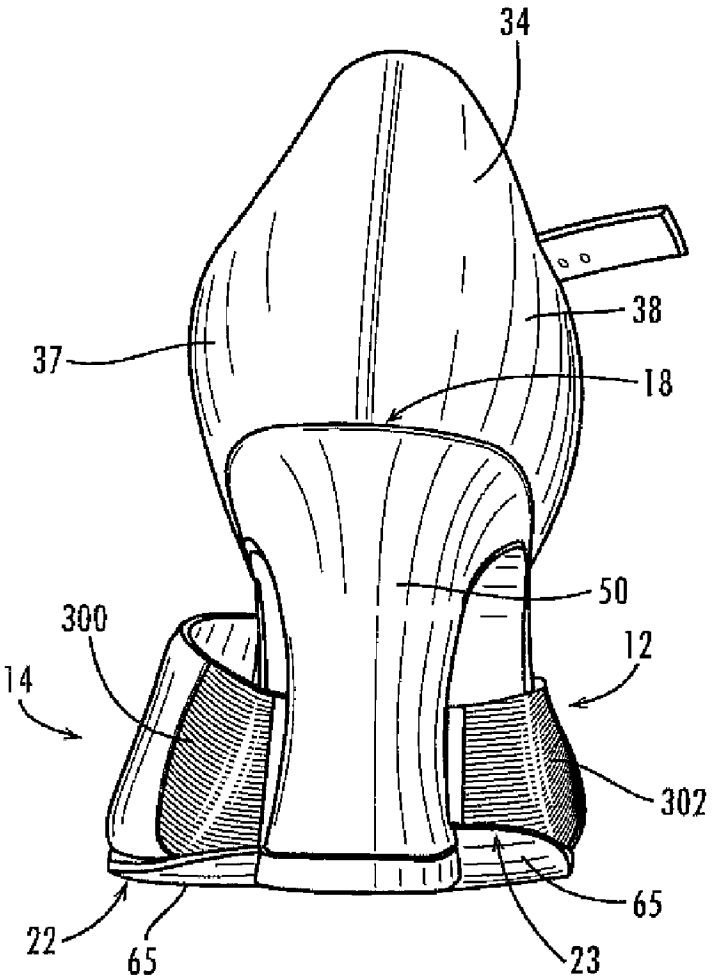
Figure 2:
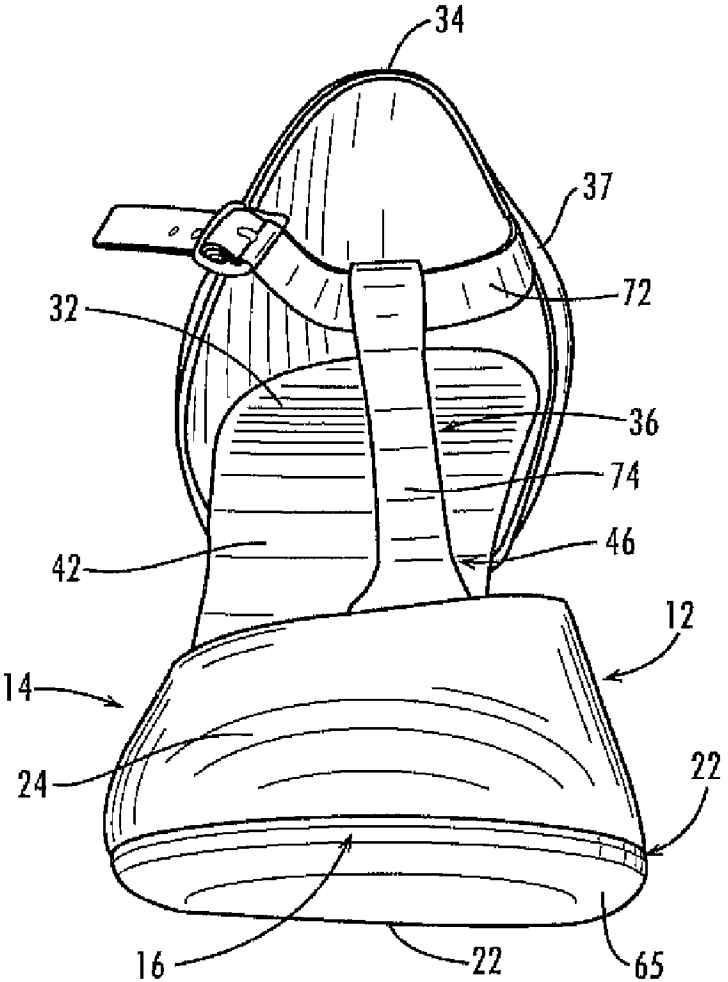
FIG. 2 is a front view of the embodiment illustrated in FIG. 1.
Figure 4:
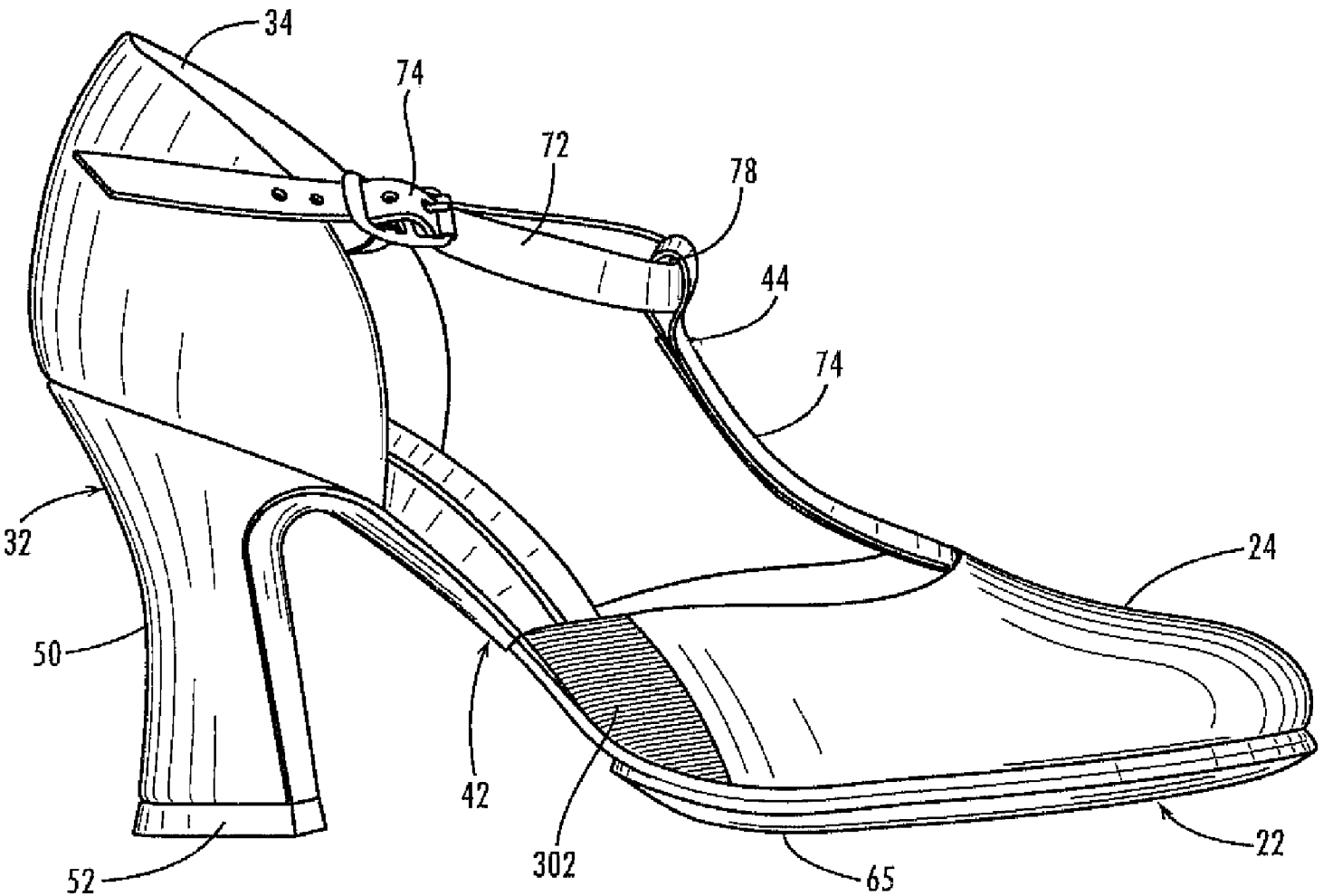
FIG. 4 is a right side view of the embodiment illustrated in FIG. 1.
Figure 5:
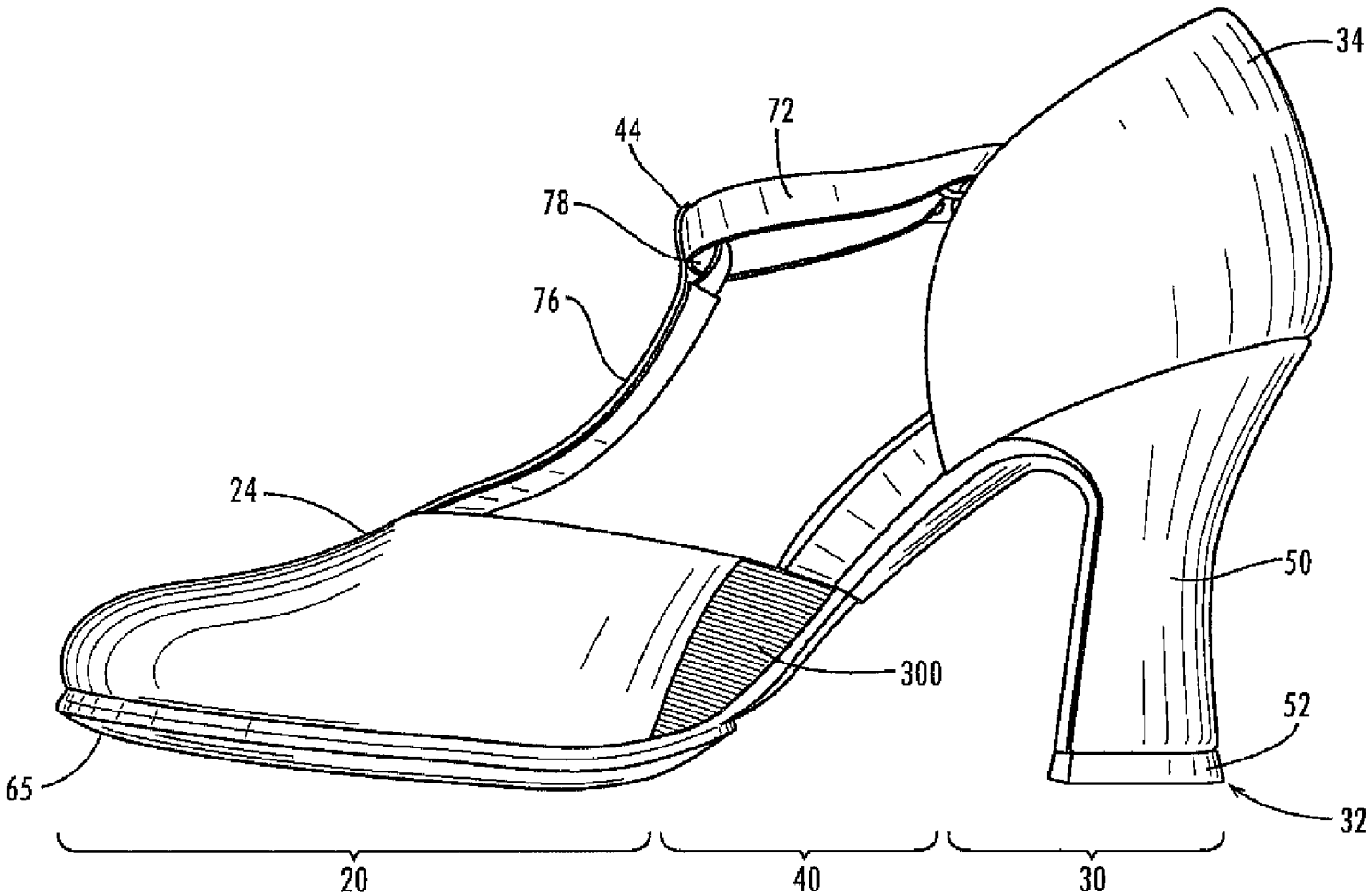
FIG. 5 is a left side view of the embodiment illustrated in FIG. 1.
Figure 6:
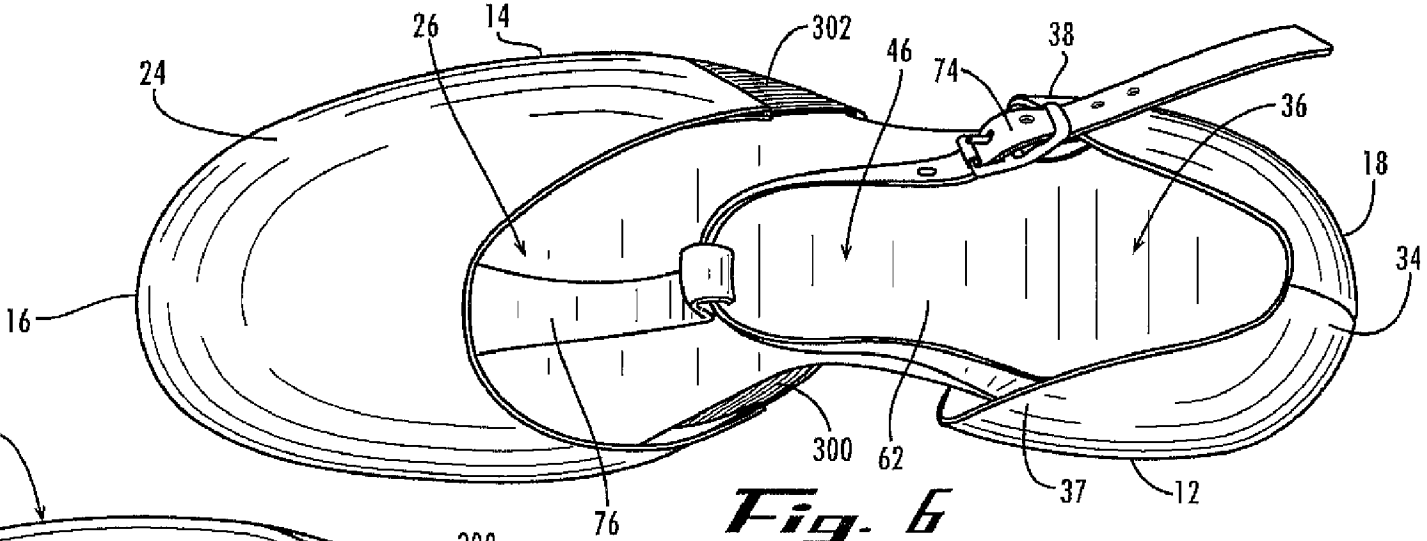
FIG. 6 is a top view of the embodiment illustrated in FIG. 1.
Figure 7:
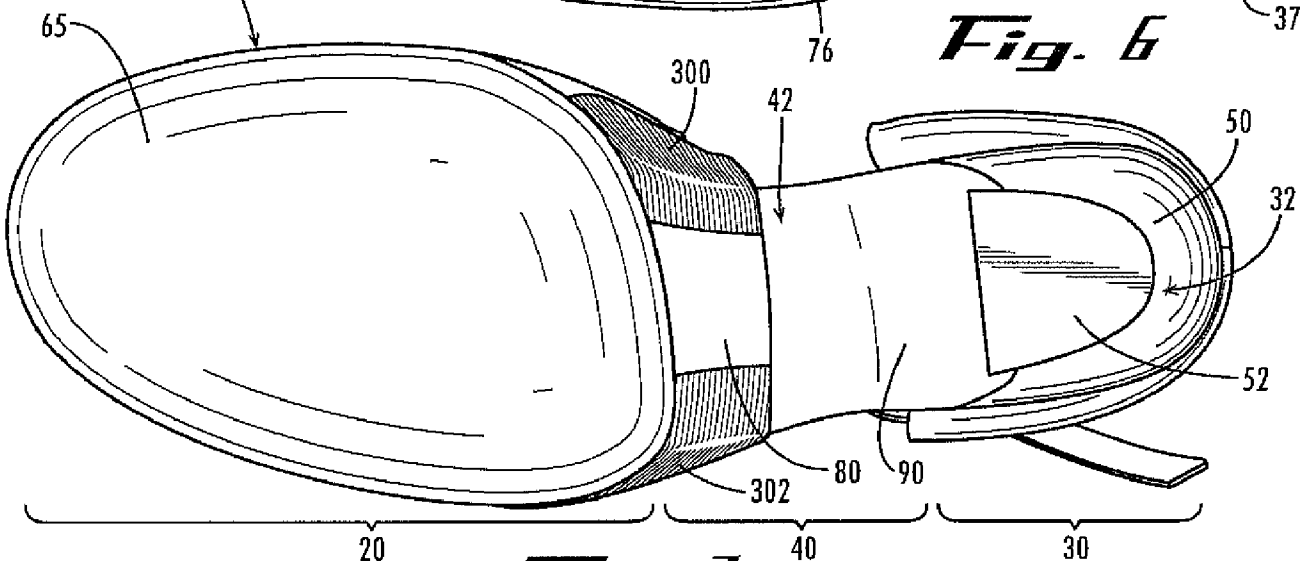
FIG. 7 is a bottom view of the embodiment illustrated in FIG. 1.
Figure 8:
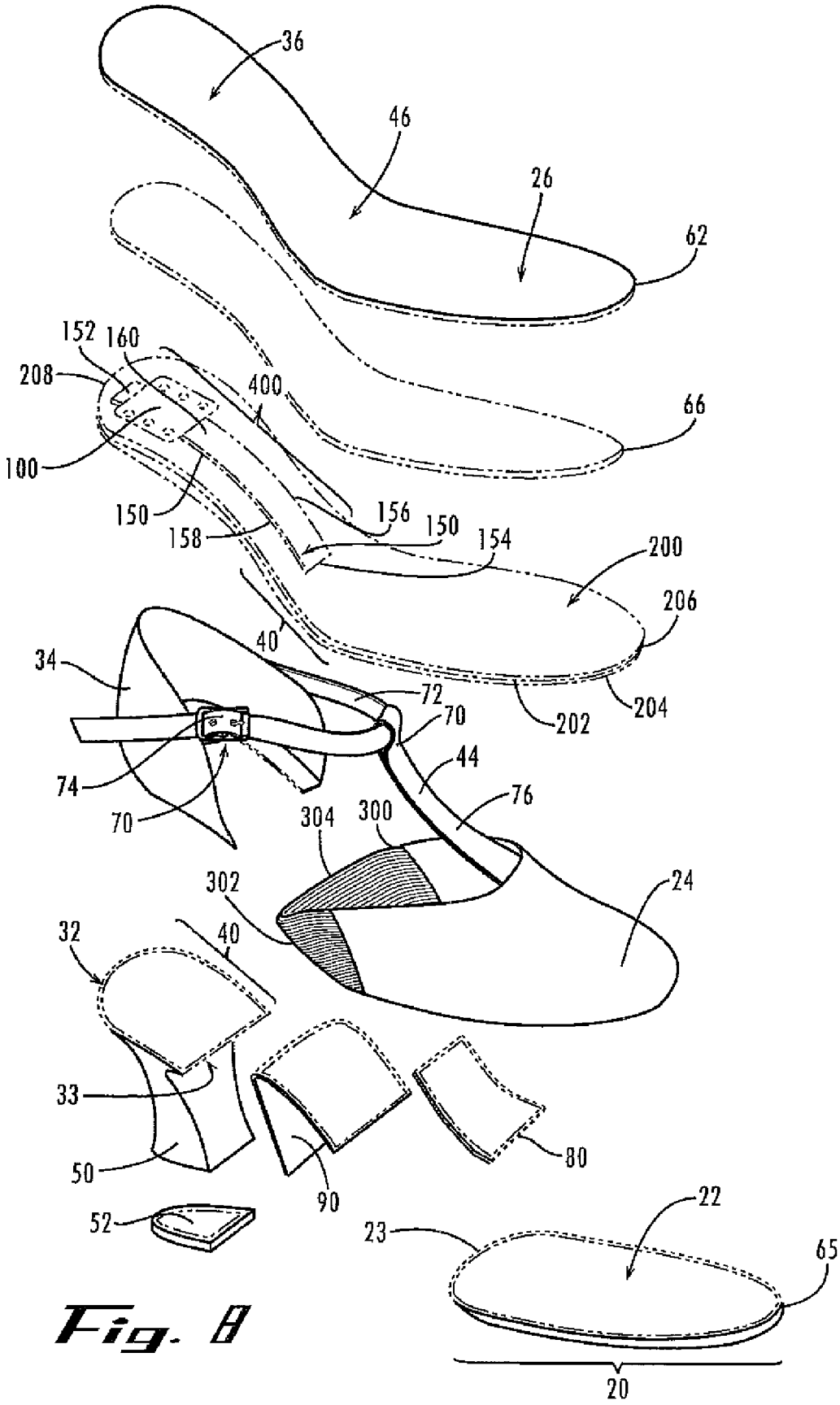
FIG. 8 is an exploded perspective view of the embodiment illustrated in FIG. 1.
Figure 9:
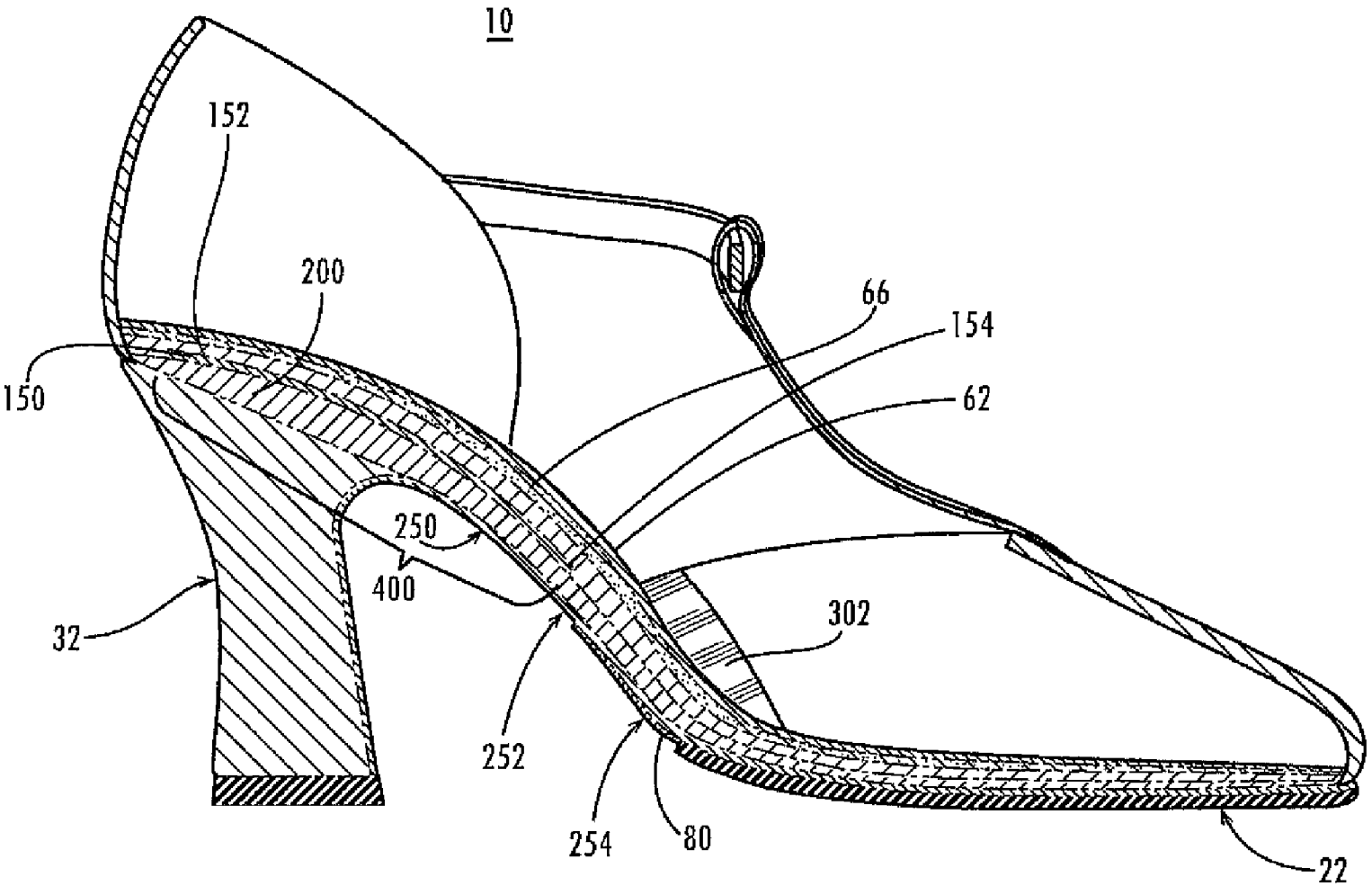
FIG. 9 is a longitudinal section of the embodiment illustrated in FIG. 1.

A representative shoe according to the inventive subject matter is illustrated in FIGS. 1-10, wherein similar features share common reference numerals. FIGS. 1-7 show external features of dance shoe 10 with a medial side 12, lateral side 14, front edge (or toe) 16 and rear edge 18. An example internal construction for shoe 10 is shown in FIGS. 8 and 9.

As an overview of the inventive features, shoe 10 is a high-heel shoe (heel height of more than about 1½ inch) that has a distinct rigidified section 400 extending from approximately a rearfoot portion 30 to partially into a midfoot portion 40, and an area forward of the rigidified section 400 that includes elastic features that allow the midfoot or arch portion to have a broader range of flexibility, but with improved support for a dancer to engage in pointe work or other moves where similar support may be needed. The shoe may also optionally include an improved upper design that facilitates flexibility, and in this regard the vamp is lower on a medial side 12 relative to the lateral side 14. This asymmetric cut also provides an improved foot aesthetic, accentuating the dancer's foot. The vamp line may encase one or more metatarsal heads for better support or containment of the foot during point work. Shoe 10 may also optionally include an improved high heel construction to help reduce the risk of breakage.

Now turning to a representative construction that includes the aforementioned inventive subject matter, shoe 10 may be characterized in terms of a forefoot portion 20, rearfoot portion 30, and a midfoot portion 40 interconnecting the forefoot and rearfoot portions. The demarcations of the front, rear and midfoot portions are as generally known to persons skilled in the art, and shown in the figures. In the embodiment shown, the forefoot portion 20 is the front portion of the shoe that underlies a wearer's toes (phalanges), metatarsals, and the metatarsal-phalangeal joints at the ball of the foot. In some embodiments, the rear edge 23 of the forefoot portion 20 approximately corresponds to the superior or proximal edge of the ball of the wearer's foot. The rearfoot portion 30 is the rear portion of the shoe that substantially surrounds and underlies a wearer's heel (calcaneus) and ankle. In some embodiments, the front edge 33 of the rearfoot portion 30 approximately corresponds to the inferior or distal edge of the wearer's calcaneus. The midfoot portion 40 lies between the forefoot 20 and rearfoot 30 portions and substantially underlies the arch of the wearer's foot, including the tarsal bones and plantar fascia. The midfoot area does not contact the ground and is sloped primarily according to the height of the high heel. In the embodiment shown, the shoe 10 includes toe spring suitable for a character dancing shoe, for example.

The forefoot portion 20 includes a forefoot sole 22 of one or more materials or structures, and an upper section 24, of one or more materials or structures, extending upwardly from it. Together, a top side of forefoot sole 22 and the upper 24 define a forefoot compartment for receiving the forefoot of a wearer. The forefoot sole 22 has a bottom side for ground contact. The sole portion may be an assembly of one or more materials. On the top side, it may include a front insole 26 that fits within a lasted foot compartment of the shoe and supports and/or cushions the wearer's foot. The bottom surface of forefoot sole 22 may be a standard outsole material, such as natural or synthetic leather, felt, wood, or a rubber or rubber-like material.

In the embodiment shown, rearfoot portion 30 includes rearfoot sole 32 and a rear upper portion 34, which together define a compartment for receiving the heel of a wearer. The rear sole and rear upper may each be an assembly of multiple materials or structures, as was the case for the forefoot portion. (This is true of the midsole assembly discussed below.) The rearfoot sole 32 may include a rear insole 36, which may be a continuation of the front insole 26. The rearfoot portion 30 has a high heel 50 that provides further structural support and helps establish the jazz dance aesthetic. The heel typically is a rigid, incompressible structure, as is well known in the art. The heel 50 includes a bottom side 52 for ground contact. This plate may be made of a standard outsole material for a high-heel dance shoe, such as rubber, leather, or plastic. The bottom side may be permanently affixed or it may be a replaceable heel plate 52. Over time, the heel plate 52 might become excessively worn from use, and replacing just this portion is both easier and less expensive than replacing the entire heel 50. Additionally, different embodiments of the shoe might include different heel plates for particular uses, such as a metal heel plate for tap dancing or a leather heel plate when quieter dance moves are needed.

The midfoot portion 40 may also be an assembly of materials, and it includes midsole portion 42 interconnecting the forefoot sole 22 and rearfoot sole 32. The midfoot portion usually, but necessarily, includes an upper portion 44. It may also include an insole 46, which provides similar functions to the corresponding structures of the forefoot and rearfoot portions. The midfoot portion 40, like the front and rear portions 20 and 30, has a ground-facing or bottom side and a foot contacting or facing top side. In the example shown, the bottom side of the midfoot portion is not intended to contact the ground. However, in other embodiments, it might. For example, there could be an in-fill of a very flexible material, such as a foam rubber, between the forefoot and rearfoot.

In the illustrated embodiment, a full length insole 62 (with subsections 26, 36, and 46) is included in shoe 10. It is shown as a continuous piece of material that substantially spans the length and width of the inside of the shoe 10. However, in alternative embodiments, the insole is formed from several pieces of material that are stitched, knitted, glued, or otherwise coupled together to form a continuous length and/or laminate structure. In a similar manner, the illustrated outsole 65 is part of a forefoot sole 22. It may be a continuous piece of material that substantially spans the width of the shoe. It may be dispersed just in the forefoot section or some greater length of the shoe from the toe to the heel. The outsole 65 may be formed from several pieces of material that are stitched, knitted, glued, or otherwise coupled together.

The outsole 65 may be exposed to wear and tear during use. Therefore, portions of the outsole 65 experiencing greater wear may be thicker than other portions that experience only minimal wear. The outsole will generally be selected from conventional materials. In dance applications, suitable materials will resist cracking or abrasion during dance moves, be non-scuffing, and allow rotation on the toes or ball of the foot. Example materials include: natural or synthetic leathers with smooth, textured, suede or other finish, rubber, EVA, and PU. In some embodiments, one or more layers of such materials layer 65 are assembled so as to afford substantial flexibility to facilitate bending of the foot, particularly dorsiflexion of the toes. In alternative embodiments, the one or more layers 65 offer limited flexibility that resists bending during pointe work or other more other moves involving dorsiflexion. In still other embodiments, one or more layers 65 offer moderate flexibility that provides some support while still allowing bending of the foot and flexion of the toes.

Between the top and bottom surfaces of any of forefoot sole 22, rearfoot sole 32 and midfoot sole 42 may be an assembly of optional layers, such as cushioning layers of soft foam rubber and the like, or additional supporting layers of hard plastic or other materials. For example, in the illustrated embodiment, a cushioning layer 66 of cotton batting or foam rubber lies directly underneath the insole 62.

The uppers 24, 34, 44 enclose some or all of the sides and top of a wearer's foot to provide a snug fit for retaining the shoe on the wearer's foot. The upper assembly shown includes an attachment system 70 composed of one or more attachment straps and a buckle that adjustably secure the shoe to the wearer's foot. Alternatively, the attachment system could be based on elastic materials or it could be excluded in favor of a slip-on construction, for example. The one or more attachment straps can be arranged and coupled onto the uppers (or other parts of the shoe) to meet the functional requirements of a secure fit and the aesthetic considerations of dance. As just one example, the illustrated attachment system 70 is composed a first attachment strap 72 connected to and extending between a medial portion 37 of rear upper 34 and a lateral portion 38 of rear upper. This first strap 72 is adjustable by means of a buckle system 74. The second attachment strap 76 slideably engages the first attachment strap 72 by means of a loop 78 at one end. The other end of the attachment strap is coupled to the midline portion 29 of the forefoot upper 24. However, attachment systems of other embodiments may have the same or a different number of straps coupled to substantially the same or different parts of the shoe or shoe upper.

Any suitable or desired materials may be used to construct the shoe, including the exemplary (non-limiting) materials described herein. For example, the upper may be constructed from pliable natural or synthetic leather; a plastic or other polymer, such as vinyl, nylon, polyester; rubber or other elastomers, including elastomeric fabrics such as spandex and Lycra®; other natural or synthetic fabrics, including polymer-based fabrics and blended fabrics, such as cotton, wool, or polyester blends; or combinations thereof. The sole may be constructed from hardened natural or synthetic leather; PU, EVA, rubber or other elastomer, such as thermoplastic elastomer SBS or SEBS composites; different types of cushioning foams or fabrics; or combinations thereof. The heel (including the heel plate) also may be constructed from hardened natural or synthetic leather as well as other materials, such as wood, plastic or other polymers, metals and alloys, or combinations thereof. For example, the heel can be made of a hard plastic with a metal heel plate for tap dancing.

To provide a rigidified section 400, as described above, various rigid elements may be used. A typical rigid element is a "shank", which is an elongate body integrated into the sole of a shoe where flex is to be eliminated or minimized. As shown in FIGS. 8 and 9, a truncated shank 150 extends between the rearfoot portion 30 and midfoot portion 40 of the shoe 10. This truncated shank 150 is an elongated member having a first end 152, a second end 154, a medial side 156, a lateral side 158, a top surface 160, and a bottom surface (not seen). This shank 150 is "truncated" because it does not extend span completely underneath the full length of the arch of the wearer's foot, through substantially the entire midfoot portion 40 of the shoe which is done in conventional shoes. The first end 152 is positioned within the rearfoot portion 30 of the shoe 10, and the truncated shank 150 extends only partway into the midfoot portion 40, with the second end 154 positioned within the midfoot portion 40 of the shoe 10 short of the forefoot portion 20.

The truncated shank 150 may extend entirely through the rearfoot portion 30, with the first end 152 positioned at or adjacent to the rear edge of the rearfoot portion 30, or the truncated shank 150 may extend only partially through the rearfoot portion 30, with the first end 152 positioned within the rearfoot portion 30 short of the shoe's rear edge. For example, in the illustrated shoe 10, the first end 152 of the truncated shank 150 overlies the heel 50.

In the illustrated embodiment, the truncated shank 150 extends from the rearfoot portion 30 of the shoe 10 through a majority of the length of the midfoot portion 40, but well short of forefoot portion 20. As an example, suitable a truncated shank for a size 7.5 (US) woman's shoe is 84.4 mm (other sizes may be scaled proportionately). In alternative embodiments, the shoe employs a shorter truncated shank 150, such as one that spans only about half of the length of the midfoot portion, or even only about a tenth of the length of the midfoot portion. For example, the truncated shank may terminate at a point underneath and behind the ball of the wearer's foot, or underneath and behind the tarsal heads of the wearer's foot, or even just a short distance distal to the calcaneus.

Table 1 provides example insole/shank (or other rigidified section 400) length and ratios suitable for shoes of the specified insole 62 length.

TABLE 1

| SIZE (U.S.) | INSOLE LENGTH | SHANK LENGTH | RATIO OF INSOLE LENGTH TO SHANK LENGTH |
|---|---|---|---|
| 5 | 231.54 mm | 81.6 mm | 2.84 |
| 5.5 | 235.77 mm | 81.6 mm | 2.89 |
| 6 | 240.00 mm | 85.0 mm | 2.87 |
| 6.5 | 244.23 mm | 85.0 mm | 2.87 |
| 7 | 248.46 mm | 88.4 mm | 2.81 |
| 7.5 | 252.63 mm | 88.4 mm | 2.86 |
| 8 | 252.92 mm | 91.8 mm | 2.76 |
| 8.5 | 261.15 mm | 91.8 mm | 2.84 |
| 9 | 265.38 mm | 95.2 mm | 2.79 |
| 9.5 | 269.61 mm | 95.2 mm | 2.93 |
| 10 | 273.84 mm | 98.6 mm | 2.78 |
| 10.5 | 278.07 mm | 98.6 mm | 2.82 |
| 11 | 282.30 mm | 102.0 mm | 2.77 |

As can be seen, the insole/shank (or other rigidified section) ratio may range from 2.77-2.93, and persons skilled in the art will appreciate and can readily determine that there may be variances from this range that still achieve the advantages of the inventive subject matter.

Additionally, the width of the truncated shank 150 may be less than the width of the shoe. For example, in the illustrated embodiment, the medial side 156 of the truncated shank 150 lies inside the medial edge 12 of the shoe 10, while the lateral side 158 of the truncated shank 150 lies inside the lateral edge 14 of the shoe. In alternative embodiments, however, the truncated shank spans the entire width of the shoe, or at least a substantial part thereof. The shank is not limited to being any particular width or shape so long as it performs a primary function of providing a rigid support to the foot under conditions of intended use. The shank need not be invariably rigid but might for some dance applications be semi-rigid and more forgiving. A suitable shank material is a rigid metal. The shank may be attached within a sole assembly using conventional methods such as gluing, screwing or nailing.

In addition to the shank, the rigidifying element may be a thin layer of a rigid material such as carbon fiber, fiberglass, wood, or plastic. For example, the rigidified section 400 could be made inflexible by constructing a support member 200 with a layer of such a material going from the rear foot to a predetermined midfoot region of the support member. The remainder of the support member could have a relatively more flexible construction.

In the illustrated embodiment, the truncated shank 150 is embedded within a semi-flexible support member 200 composed of one or more materials or structures. FIG. 8 shows a two layer support member. A support member may be made from any suitable semi-flexible material including (but not limited to) leatherboard, redboard, fiberboard, red electrical board, Texon board, or combinations or composites thereof. The support member 200 provides a platform for supporting the wearer's foot, especially underneath the arch of the foot, but is not as rigid as the truncated shank 150.

In the illustrated embodiment, support member 200 is semi-flexible material that is at least slightly longer and wider than the truncated shank 150. It has a first (distal) end 206 and a second (proximal) end 208. In this example, the support member follows the full length and width of the shoe, like insole 62. Usually, the first end 206 of the support member 200 extends through the entire midfoot portion 40 of the shoe distal to the first (distal) end 152 of the truncated shank 150. For example, the illustrated embodiment includes a support member 200 with its first end 206 placed adjacent the front edge 16 of the shoe 10. In this embodiment, the support member provides a primary base of support for the foot of a wearer.

The combination of a rigidified section, such as truncated shank 150, and a semi-flexible support member 200, which may vary in thickness or materials, provides two or more zones of flexibility within the midfoot portion 40 of the shoe 10. For example, the illustrated embodiment includes a first zone 250 of no flexibility, or relatively little flexibility, within the midfoot portion 40 adjacent the rearfoot portion 30; a second zone of relatively moderate flexibility 252 adjacent the second end 154 of the truncated shank 150; and a third zone of relatively substantial flexibility 254 within the midfoot portion 40 adjacent the forefoot portion 20. These zones, may, for example be determined by the nature of the materials used or variations in their thickness. Thus, the degree and ease of flexibility within the midfoot portion 40 of the shoe 10 discretely or progressively increases from back to front. This varying flexibility facilitates a dancer's ability to perform dance movements, such as providing enhanced flexibility at demi pointe and at pointe. A dancer can more easily perform in a demi pointe stance in this shoe having progressive flexibility along the midfoot portion—and can more easily achieve pointe to enhance the line of the foot—compared to traditional shoes having only one degree of flexibility underneath the midfoot, such as a shoe having a rigid shank extending along the substantial or entire length of its midfoot portion.

Optionally, the upper of the shoe may include one or more elastic sections. In the figures, shoe 10 has a medial side section 300 and lateral side section 302. In certain respects the inventive subject matter contemplates that the elastic may have an elastic section 304 that is positioned between sections 300 and 302 under some or the entire underside of a foot. The elastic sections may extend proximally from at or before a rear edge of the forefoot section to the edge of the forefoot portion or even within the midfoot portion. The elastic sections facilitate flexion of the upper while the shoe is worn. In this context, the sections are "elastic" because they are capable of recovering their original sizes and shapes after deformation. The construction of any elastic section is not limited to elastic rubber—other materials with suitable degrees of elasticity may be used including (but not limited to) rubber and other elastomers, elastomeric fabrics such as spandex or Lycra®, or combinations thereof. In the embodiment shown In the illustrated embodiment, the first elastic section 300 is positioned on the medial side 27 of the forefoot upper 24, and the second elastic insert 302 is positioned on the lateral side of the forefoot upper 24. Elastic section 304 is adjacent sections 300 and 302 and interconnects those sections across the entire underside of the foot. Elastic sections 300, 302, 304 extend below support member 200, which in turn is below padding 66 and insole 62. The flexible sections may be positioned elsewhere along the forefoot and/or rearfoot upper to facilitate flexion of the upper during movement of the foot while the shoe is worn, particularly during pointing of the shoe. The elastic sections may be formed of a single piece or multiple pieces of material.

To help secure the elastic section in place, shoe 1 optionally includes an optional layer or a reinforcement material 80 that is connected to the sole assembly by, for example, gluing or stitching. A suitable material is a durable fabric or leather material, for example. Similarly, an optional reinforcement 90 of similar material extends from about proximally of the rear edge of the elastic sections and wraps down the front face of heel 50.

The rear foot portion optionally includes a heel retainer 100 that attaches to the sole assembly over the first end 152 of shank 150. Nails, screws or other conventional fastening means (not shown) may be used to secure the retainer to the heel assembly. The heel retainer may be a thin metal or other rigid plate material.

Figures 10A, 10B, 10C:
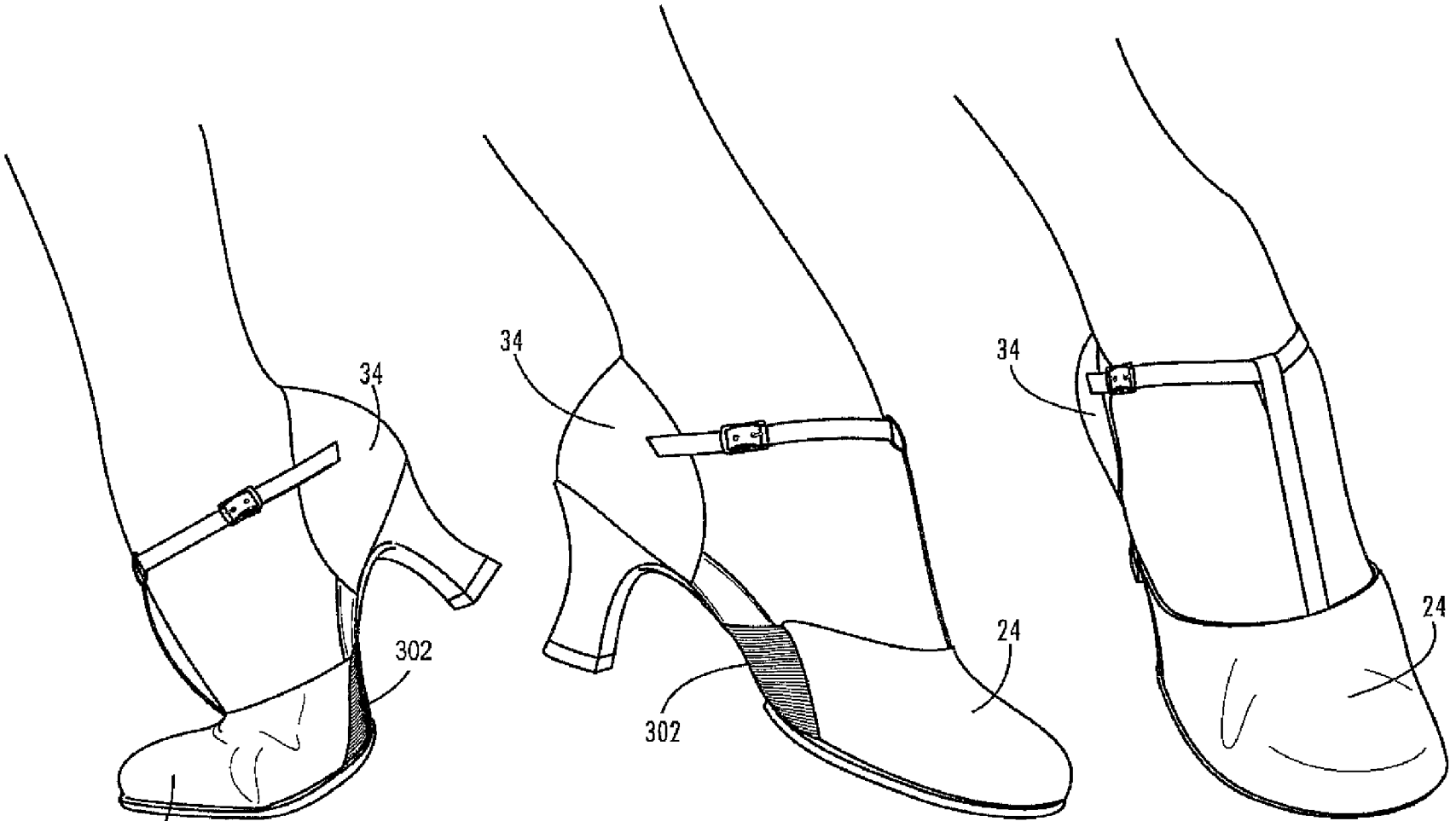
FIGS. 10A-C illustrate the shoe on the foot of a dancer.

FIGS. 10A-10C show different views of an embodiment of an inventive shoe on the foot of a wearer, with the foot in different positions. FIG. 10A shows how the shoe flexibly accommodates the foot through a broad range of dorsiflexion. FIGS. 10B and 10C show how the shoe also flexibly accommodates the foot through a broad range of plantar flexion (pointing). In this position, the elastic sections 300/302 stretch, the vamp line stays over the metatarsal heads, and rigidified section 400 follows the under arch of the foot. FIG. 10C shows the relatively high vamp line for a character type shoe. The vamp line encases and helps contain the metatarsals, and in combination with the rigidified section 400 and tensioning of the upper against the foot as the foot undergoes plantar flexion, helps provide an improved range of movement while still allowing the support needed when the foot is weight bearing over the midfoot portion of the shoe. As used herein a "substantial" full range of movement means a full range of movement or a lesser than full range but which to a casual observer of dance would appear to be a full or very close to full range of movement. As indicated, the elastic sections 300, 302 and 304 help the shoe hug the foot during both dorsiflexion and plantar flexion.

In contrast to the inventive shoe, the longer shank of a conventional high heel shoe does not achieve a suitable balance of flexibility and support. It has been observed that in high-heel shoes with a traditional, full length shank spanning all or substantially all of the midfoot, problems occur when a dancer attempts pointing: (1) the shoe does not flex with the foot, forcing the dancers metatarsals out of the shoe or the shoe coming off the foot; (2) the shoe is too strong and the foot is blocked from pointing; and, (3) in the case of a weak shoe, the shoe may break. On the other hand, in high heel shoes, if the shank does not exist or is too short, i.e., does not extend sufficiently into the midfoot from the heel, the heel portion of the shoe moves back from the forward portions causing the shoe to be wobbly, unstable and not supportive. Accordingly, an ideal high heel shoe for pointing would have no shank and would allow full plantar extension. However, a high heel shoe without a shank or otherwise rigidified section would not allow weight bearing moves. The inventions described herein provide a novel solution to this dilemma posed by these conflicting needs.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed:

1. A shoe for dancing, comprising:

a forefoot portion, wherein the forefoot portion comprises a forefoot sole and a front upper;

a rearfoot portion comprising a rearfoot sole including a high heel;

a midfoot portion comprising a midfoot sole;

a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement; and an elastic section in a midfoot portion of the shoe allowing the shoe to flexibly conform to the foot during dorsiflexion and plantar flexion.

2. The shoe of claim 1 wherein the rigidified section comprises a truncated shank, wherein the truncated shank is an elongated member with a first end, a second end, a medial side, and a lateral side, and wherein the truncated shank extends at least partway from the rearfoot portion to partway into the midfoot portion.

3. The shoe of claim 2, wherein the first end of the truncated shank spans substantially the full length of the heel.

4. The shoe of claim 3, wherein the truncated shank is embedded in a portion of a midfoot sole comprising a semi-flexible support member, the support member providing a foot support structure spanning from within the rearfoot portion to within the forefoot portion.

5. The shoe of claim 4, wherein the forefoot portion comprises forefoot sole comprising an assembly of an insole layer, a cushioning layer disposed below the insole layer and above the support member, and an outsole layer disposed below the support member.

6. The shoe of claim 1 further comprising a heel retainer comprising a plate coupling the rearfoot sole to the heel.

7. The shoe of claim 1 wherein the ratio of an insole length of the shoe to the rigidified section is 2.5-3.0.

8. The shoe of claim 1 wherein the ratio of an insole length of the shoe to the rigidified section is 2.75-2.95.

9. A shoe for dancing, comprising:

a forefoot portion, wherein the forefoot portion comprises a forefoot sole and a front upper;

a rearfoot portion comprising a rearfoot sole including a high heel;

a midfoot portion comprising a midfoot sole;

a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement; and wherein the shoe includes an elastic section on a medial side of the shoe and an elastic section on a lateral side of the shoe, the elastic sections allowing the shoe to flexibly conform to the foot during dorsiflexion and plantar flexion.

10. A shoe for dancing, comprising:

a forefoot portion, wherein the forefoot portion comprises a forefoot sole and a front upper;

a rearfoot portion comprising a rearfoot sole including a high heel;

a midfoot portion comprising a midfoot sole;

a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement; and further wherein an upper for the shoe comprises a first elastic section positioned on the medial side of the shoe at about a forefoot to about a midfoot portion of the shoe, and a second elastic section positioned on the lateral side of the shoe at about a forefoot to about midfoot portion of the shoe.

11. The shoe of claim 10 further comprising an underfoot section of elastic that is positioned underneath the foot between the lateral and medial sections.

12. The shoe of claim 11 wherein the underfoot section extends across the entire underfoot, and wherein the lateral, medial and underneath elastic sections form a single continuous structure.

13. The shoe of claim 12 wherein the front end of the rigidified section terminates before the rear edge of the elastic underfoot section.

14. A shoe for dancing, comprising:

a forefoot portion, wherein the forefoot portion comprises a forefoot sole and a front upper;

a rearfoot portion comprising a rearfoot sole including a high heel;

a midfoot portion comprising a midfoot sole;

a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement;

wherein the rigidified section comprises a truncated shank, wherein the truncated shank is an elongated member with a first end, a second end, a medial side, and a lateral side, and wherein the truncated shank extends at least partway from the rearfoot portion to partway into the midfoot portion;

wherein the first end of the truncated shank spans substantially the full length of the heel;

wherein the truncated shank is embedded in a portion of a midfoot sole comprising a semi-flexible support member, the support member providing a foot support structure spanning from within the rearfoot portion to within the forefoot portion;

wherein the forefoot portion comprises a forefoot sole comprising an assembly of an insole layer, a cushioning layer disposed below the insole layer and above the support member, and an outsole layer disposed below the support member;

wherein the sole of the shoe within the midfoot portion has three or more zones of differing flexibility.

15. A shoe for dancing, comprising:

a forefoot portion, wherein the forefoot portion comprises a forefoot sole and a front upper;

a rearfoot portion comprising a rearfoot sole including a high heel;

a midfoot portion comprising a midfoot sole;

a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement;

wherein the vamp line for the front upper is constructed to extend asymmetrically higher on the lateral top side of a wearer's foot relative to the top medial side.

16. A shoe for dancing, comprising:

a forefoot portion, wherein the forefoot portion comprises a forefoot sole and a front upper;

a rearfoot portion comprising a rearfoot sole including a high heel;

a midfoot portion comprising a midfoot sole;

a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight bearing midfoot, and the second zone being relatively flexible, the overall midfoot portion allowing the wearer to perform both dorsiflexion and plantar flexion of the foot over a full range of movement;

wherein the vamp line for the front upper extends on the lateral side of the shoe above at least two metatarsal heads of the wearer's foot.

17. The shoe of claim 16 wherein the vamp line extends above all metatarsal heads of the wearer's foot and stays above the metatarsal head through a full range of plantar flexion.

18. A shoe for jazz and character dancing having a toe and a heel, comprising:

an elongated semi-flexible support member having a rearfoot portion, a midfoot portion and a forefoot portion;

a front outsole portion coupled to the underside of the support member, the front outsole portion extending from about the distal end of the forefoot portion of the support member to a portion of the support member underlying the arch of the foot when the shoe is worn;

a high heel coupled to a rearfoot portion of the support member;

a front shoe upper coupled to the forefoot portion of the support member;

a rear shoe upper coupled to the rearfoot portion of the support member, above the high heel; and a truncated shank coupled to the proximal portion of the support member, the truncated shank extending from about the rearfoot portion to an area underlying the proximal portion of the arch of the foot when the shoe is worn; and an elastic section in a midfoot portion of the shoe allowing the shoe to flexibly conform to the foot during dorsiflexion and plantar flexion.

19. A method of making a shoe for dancing, comprising:

forming a forefoot portion, wherein the forefoot portion comprises a forefoot sole and a front upper;

forming a rearfoot portion comprising a rearfoot sole including a high heel;

forming a midfoot portion comprising a midfoot sole; and forming a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight-bearing midfoot, and the second zone being relatively flexible, the overall midfoot portion allowing the wearer to perform both dorsi flexion and plantar flexion of the foot over a full range of movement and an elastic section in a midfoot portion of the shoe allowing the shoe to flexibly conform to the foot during dorsiflexion and plantar flexion.

20. The method of claim 19 wherein the rigidified section comprises a truncated shank, wherein the truncated shank is an elongated member with a first end, a second end, a medial side, and a lateral side, and wherein the truncated shank extends at least partway from the rearfoot portion to partway into the midfoot portion.

21. The method of claim 20 wherein the first end of the truncated shank spans substantially the full length of the heel.

22. The method of claim 21 wherein the truncated shank is embedded in a portion of a midfoot sole comprising a semi-flexible support member, the support member providing a foot support structure spanning from within the rearfoot portion to within the forefoot portion.

23. A method of making a shoe for dancing, comprising:

forming a forefoot portion, wherein the forefoot portion comprises a forefoot sole and a front upper;

forming a rearfoot portion comprising a rearfoot sole including a high heel;

forming a midfoot portion comprising a midfoot sole; and forming a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight-bearing midfoot, and the second zone being relatively flexible, the overall midfoot portion allowing the wearer to perform both dorsi flexion and plantar flexion of the foot over a full range of movement;

further comprising forming elastic sections, wherein an upper for the shoe comprises a first elastic section positioned on the medial side of the shoe at about a forefoot to about a midfoot portion of the shoe, and a second elastic section positioned on the lateral side of the shoe at about a forefoot to about midfoot portion of the shoe, and further comprising forming an underfoot section of elastic that is positioned underneath the foot between the lateral and medial sections.

24. The method of claim 23 wherein the underfoot section extends across the entire underfoot, and wherein the lateral, medial and underneath elastic sections form a single continuous structure.

25. A method of making a shoe for dancing, comprising:

forming a forefoot portion, wherein the forefoot portion comprises a forefoot sole and a front upper;

forming a rearfoot portion comprising a rearfoot sole including a high heel;

forming a midfoot portion comprising a midfoot sole; and forming a rigidified section that extends at least partway from the rearfoot portion to partway into the midfoot portion, leaving a gap between the rear edge of the forefoot portion and the front end of the rigidified section so that there are at least two zones of flexibility in the midfoot portion, the first zone being relatively rigid for supporting a weight-bearing midfoot, and the second zone being relatively flexible, the overall midfoot portion allowing the wearer to perform both dorsi flexion and plantar flexion of the foot over a full range of movement;

further comprising forming a vamp line for the front upper, wherein the vamp line is constructed to extend asymmetrically higher on the lateral top side of a wearer's foot relative to the top medial side, and wherein the vamp line extends on the lateral side of the shoe above at least two metatarsal heads of the wearer's foot.

* * * * *